US006190456B1

(12) United States Patent
Matsuda

(10) Patent No.: US 6,190,456 B1
(45) Date of Patent: Feb. 20, 2001

(54) SPACER SPRAYING DEVICE

(75) Inventor: Akehiro Matsuda, Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/116,212

(22) Filed: Jul. 16, 1998

(30) Foreign Application Priority Data

Jul. 17, 1997 (JP) ..... 9-192557

(51) Int. Cl.[7] ..... B05C 19/04
(52) U.S. Cl. ..... 118/629; 118/326; 118/308
(58) Field of Search ..... 118/50.1, 620, 118/629, 308, 326, 319, 320, 50, 52, 56, 309; 427/180, 168, 64, 68

(56) References Cited

U.S. PATENT DOCUMENTS

| | | | | |
|---|---|---|---|---|
| 4,687,686 | * | 8/1987 | Stofuth et al. | 118/326 |
| 5,153,034 | * | 10/1992 | Telchuk et al. | 118/326 |
| 5,173,118 | * | 12/1992 | Josefsson | 118/308 |
| 5,194,297 | * | 3/1993 | Scheer et al. | 118/308 |
| 5,634,975 | * | 6/1997 | Josefsson | 118/326 |

FOREIGN PATENT DOCUMENTS

| | | |
|---|---|---|
| 1-94321 | 4/1989 | (JP) . |
| 5-127169 | 5/1993 | (JP) . |
| 5-158049 | 6/1993 | (JP) . |
| 6-3679 | 1/1994 | (JP) . |
| 6-3498 | 2/1994 | (JP) . |
| 6-148586 | 5/1994 | (JP) . |
| 7-20415 | 1/1995 | (JP) . |
| 8-43832 | 2/1996 | (JP) . |
| 8-220544 | 8/1996 | (JP) . |
| 8-294659 | 11/1996 | (JP) . |
| 8-328020 | 12/1996 | (JP) . |
| 10-123533 | 5/1998 | (JP) . |

* cited by examiner

*Primary Examiner*—Laura Edwards
(74) *Attorney, Agent, or Firm*—Sughrue, Mion, Zinn, Macpeak & Seas, PLLC

(57) ABSTRACT

A spacer spraying device for spraying a powdery spacer onto, e.g., a substrate for an LCD (Liquid Crystal Display) is disclosed. When the device sprays the spacer onto the top of the substrate in a spray chamber, it prevents the spacer from depositing on the inner side walls and top wall of the chamber and dropping in the form of cohered masses onto the substrate.

10 Claims, 4 Drawing Sheets

SPACER SPRAYING DEVICE

BACKGROUND OF THE INVENTION

The present invention relates to a spacer spraying device for spraying a powdery spacer and, more particularly, to a spacer spraying device for spraying a powdery spacer onto a substrate to be included in an LCD (Liquid Crystal Display) in order to form a preselected gap between it and the other substrate.

It is a common practice with an LCD to form a spacer between a pair of substrates for spacing them from each other. The spacer is implemented by acrylic resin powder and deposited on the top of a substrate by either one of a wet process and a dry process. In the wet process, a preselected amount of spacer is mixed with, e.g., water or alcohol solvent and then sprayed into a spray chamber in which a substrate is positioned. At the same time, the inside of the spray chamber is heated. As a result, water or solvent is evaporated while only the spacer is deposited on the top of the substrate. A problem with the wet process is that when water or solvent is not fully evaporated, it leaves marks on the top of the substrate which would form undesirable spots on the resulting LCD or bring about irregular display. Another problem is that the spacers formed on two substrates each coheres in the form of masses and renders the gap between the substrates adhered to each other inadequate.

The dry process uses a gas, as follows. A preselected amount of spacer is fed to a nozzle via a metal pipe and a resin pipe together with air compressed to 2 kg/cm$^2$ to 3 kg/cm$^2$. The nozzle sprays the spacer into a spray chamber in which a substrate is positioned, while being moved zigzag by a drive motor. A first problem with the dry process is that the atomized spacer in the chamber deposits on the inner side walls and top wall of the chamber and is apt to drop in the form of masses due to, e.g., vibration ascribable to the movement of the nozzle. The deposition of the spacer on the above walls is ascribable to convection in the chamber, as will be described specifically later. A second problem is the waste of spacer ascribable to the fact that the amount of spacer for a single substrate should take account of the part of the spacer to deposit on the walls of the chamber, the spacer sequentially deposits on the walls until the walls reach the same potential as the spacer.

Technologies relating to the present invention are disclosed in, e.g., Japanese Patent Laid-Open Publication Nos. 5-127169, 6-3679, 6-34982, and 6-148586.

SUMMARY OF THE INVENTION

It is therefore an object of the present invention to provide a spacer spraying device capable of preventing a spacer from depositing on the side walls and top wall of a spray chamber, and allowing the spacer to be fed in an adequate amount.

A spacer spraying device of the present invention has a spray chamber in which a substrate for an LCD is positioned, a nozzle for spraying a spacer into the spray chamber toward the substrate, and a filter unit mounted on the top of the spray chamber. Air is fed from the outside to the inside of the spray chamber via the filter unit and caused to flow downward toward the bottom of the spray chamber.

BRIEF DESCRIPTION OF THE DRAWINGS

The above and other objects, features and advantages of the present invention will become apparent from the following detailed description taken with the accompanying drawings in which.

Figure 1:
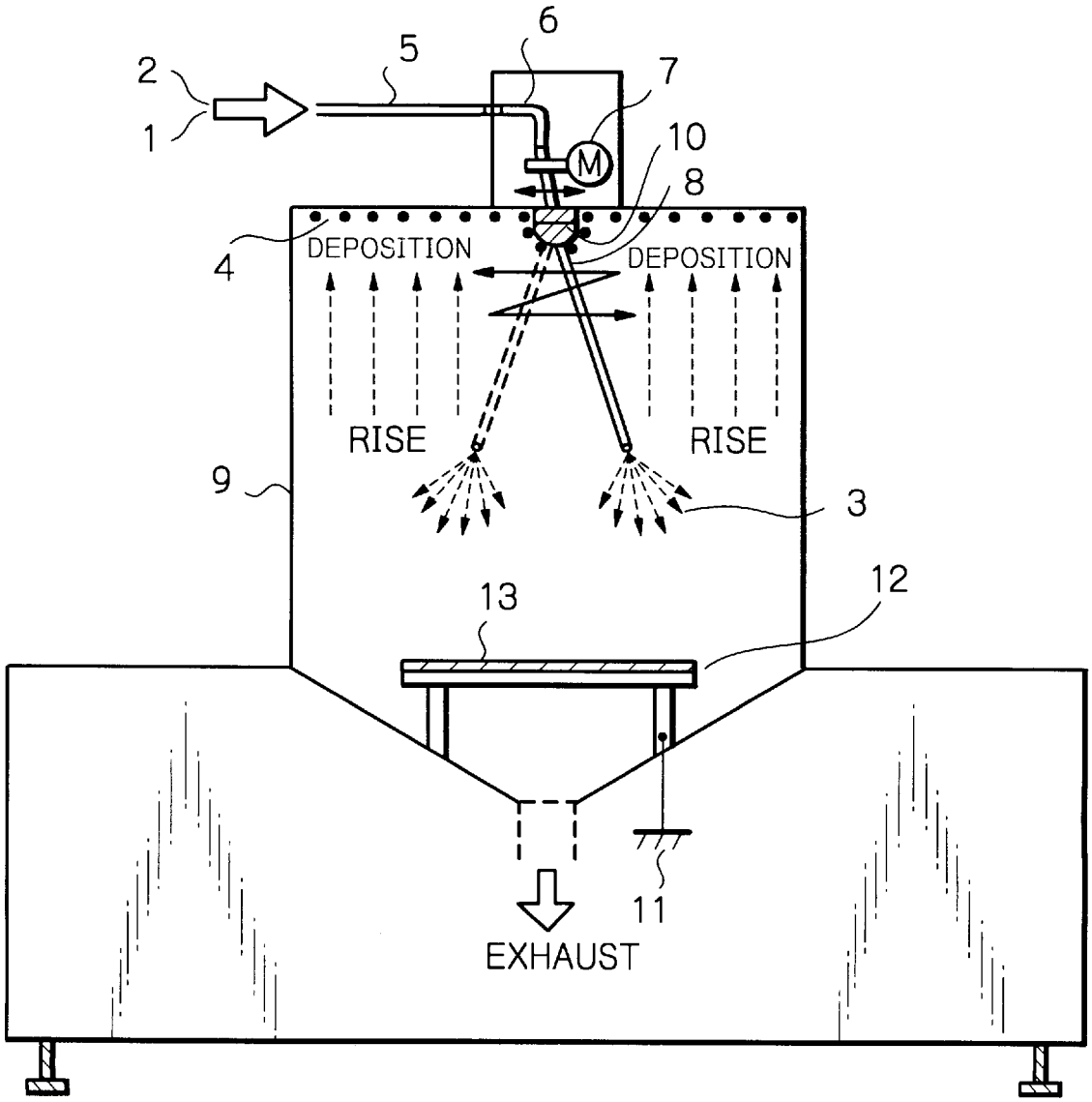
Fig. 1 PRIOR ART
FIG. 1 shows a conventional spacer spraying device.

In the figures, identical references denote identical structural elements.

DESCRIPTION OF THE PREFERRED EMBODIMENTS

To better understand the present invention, brief reference will be made to a conventional spacer spraying device of the type using a gas and applicable to the substrate of an LCD, shown in FIG. 1. As shown, the device includes a spray chamber 9 in which a substrate 13 is positioned, and sprays an atomized spacer 3 from above the substrate 13. Specifically, a preselected amount of spacer 1 is fed to a nozzle 8 via a metal pipe 5 and a resin pipe 6 together with air 2 compressed to 2 kg/cm$^2$ to 3 kg/cm$^2$. The nozzle 8 sprays the spacer 3 into the spray chamber 9 while being moved zigzag by a drive motor 7. The resin pipe 6 allows the nozzle 8 to move zigzag due to its elasticity. A flexible nozzle cover 10 formed of rubber is attached to the nozzle 8 in order to prevent dust produced from the movable portion from dropping.

The spacer 3 sprayed onto the substrate 13 is implemented by an insulative acrylic resin. It is therefore likely that the spacer 3 is electrostatically charged to above +5 V while repeatedly impinging on the walls of the metal pipe 5 and resin pipe 6. On the other hand, a stage 12 loaded with the substrate 13 is connected to ground 11, so that a charge deposited on the top of the substrate 13 is 35 0 kV. As a result, the spacer 3 with the above charge is electrostatically attracted by and deposited on the top of the substrate 13, forming a spacer thereon.

However, the problem with the above spacer spraying device is that the atomized spacer 3 in the chamber 9 is partly convected and deposited even on the side walls and top wall of the chamber 9 and the nozzle cover 10, as represented by dots 4 in FIG. 1. When the spacer 4 accumulates and coheres, it is apt to drop in the form of masses due to the movement of the nozzle 8 or the conveyance of the substrate 13. Such masses render the gap between two substrates adhered together inadequate, as stated earlier.

In light of the above, Japanese Patent Laid-Open Publication No. 5-127169 mentioned earlier proposes a spacer spraying device for an LCD panel. The device taught in this document feeds a preselected amount of spacer together with dehydrated compressed air, roughly removes the cohered masses of the spacer with a filter, and forcibly charges the spacer to negative polarity in the vicinity of a nozzle in order to further scatter the spacer. This kind of scheme also has the above problem because the spacer sprayed into a spray chamber is convected and caused to deposit on the walls of the chamber.

Japanese Patent Laid-Open Publication No. 6-34982 teaches a method and an apparatus for spraying a spacer and including an ionizer disposed in an air conduit. Air ionized by the ionizer regulates the spacer to the same polarity, so that the spacer is scattered due to charging. Even this approach, however, cannot solve the convection problem discussed above.

Figure 2:
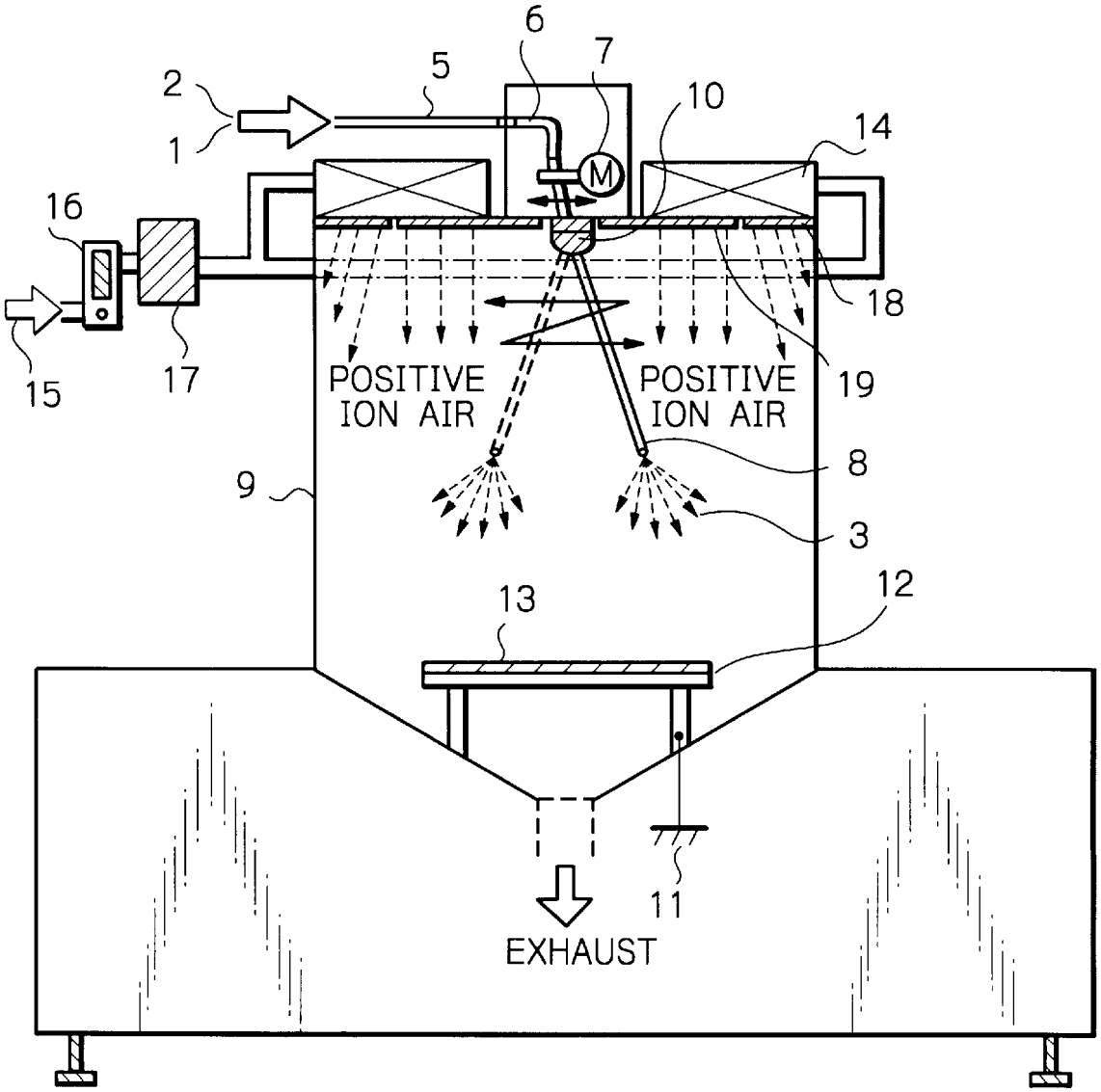
FIG. 2 shows a spacer spraying device embodying the present invention.

Referring to FIG. 2, a spacer spraying device embodying the present invention will be described. As shown, the device includes a metal pipe 6 and a resin pipe 5 for feeding a preselected amount of spacer 1 together with air under pressure 2. A nozzle 8 is connected to the end of the resin pipe 6 and sprays an atomized spacer 3 from above a substrate 13 set on a stage 12. The nozzle 8 is moved zigzag by a drive motor 7 in the right-and-left direction, as viewed in FIG. 2. The stage 12 is connected to ground 11. A nozzle cover 10 covers a fulcrum about which the nozzle 8 is movable, receiving dust ascribable to the movement of the nozzle 8. Dry air 15 is fed under pressure into a spray chamber 9 via a flow meter 16 and an ionizer 17. The flow meter 16 allows the flow rate of dry air 15 to be freely controlled. The ionizer 17 charges dry air 15. Dry air 15 charged by the ion source 17 is fed to a filter unit 14 mounted on the top of the spray chamber 9.

Figure 3:
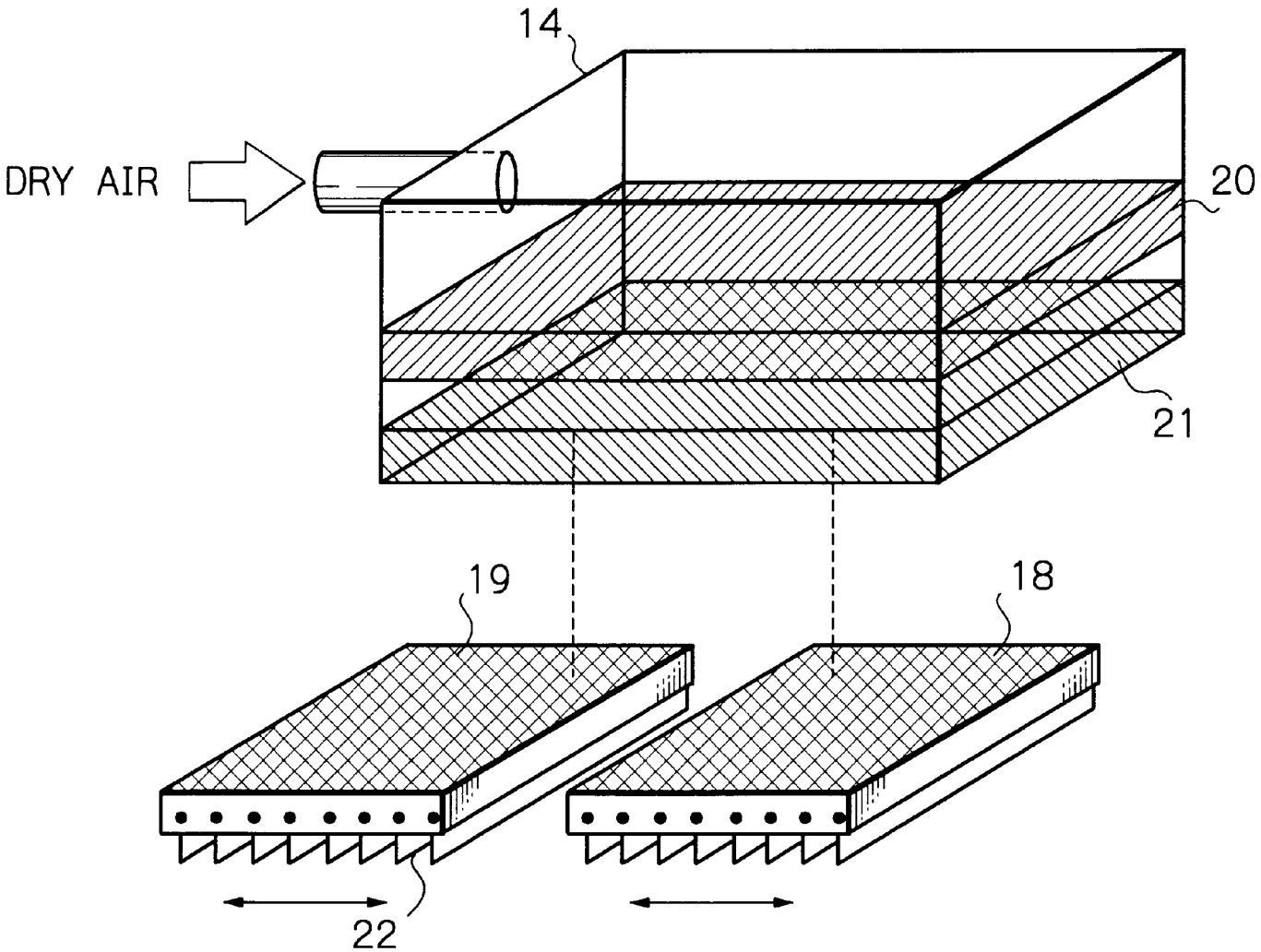
FIG. 3 is a perspective view of a filter unit included in the illustrative embodiment.

FIG. 3 shows a specific configuration of the filter unit 14. As shown, the filter unit 14 is made up of a prefilter 20 and a final filter 21 underlying the prefilter 20 and removes mainly the mist of dry air. Shutters 18 and 19 are mounted on the bottom of the filter unit 14, and each has a manual adjuster 22 for adjusting the direction of an air stream.

In operation, a preselected amount of spacer 1 is fed to the nozzle 8 via the metal pipe 5 and resin pipe 6 together with air 2 compressed to 2 kg/cm$^2$ to 3 kg/cm$^2$. The nozzle 8 sprays the spacer 3 into the spray chamber 9 while being moved zigzag by the drive motor 7. The resin pipe 6 allows the nozzle 8 to move zigzag due to its elasticity.

The spacer 3 sprayed into the spray chamber 9 is implemented by an insulative acrylic resin. It is therefore likely that the spacer 3 is electrostatically charged to above +5 V while repeatedly impinging on the walls of the metal pipe 5 and resin pipe 6. On the other hand, the stage 12 loaded with a substrate 13 is connected to ground 11, so that a charge deposited on the top of the substrate 13 is ±0 kV. As a result, the spacer 3 with the above charge is electrostatically attracted by and deposited on the top of the substrate 13, forming a spacer thereon.

Dry air 15 charged to the same polarity as the atomized spacer 3, i.e., positive polarity by the ionizer 17 is constantly fed into the spray chamber 9 via the filter unit 14. The shutter 18 with the manual adjuster 22 is so adjusted as to direct air with positive ions toward the side walls of the spray chamber 9, thereby charging the walls to positive polarity. As a result, repulsion acts between the side walls of the chamber 9 and the spacer 3 also charged to the positive polarity, preventing the spacer 3 from depositing on the side walls. On the other hand, the shutter 19 with the manual adjuster 22 is so adjusted as to direct air with positive ions vertically downward toward the bottom of the chamber 9. This successfully prevents the spacer 3 from flowing upward due to convection.

Figure 4:
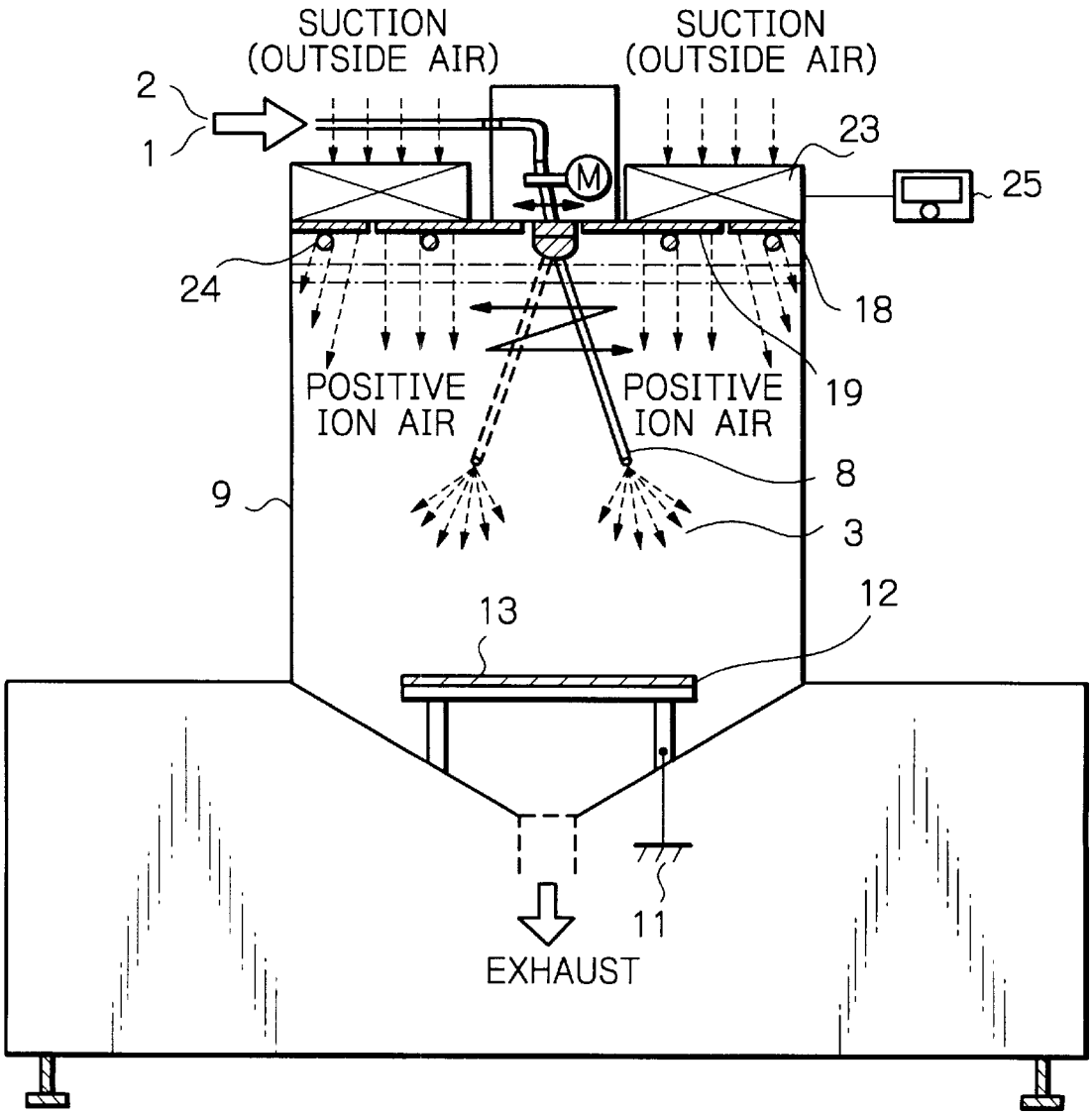
FIG. 4 shows an alternative embodiment of the present invention.

An alternative embodiment of the present invention will be described with reference to FIG. 4. As shown, this embodiment includes a filter unit 23 including a fan for blowing filtered air into the spray chamber 9. A fan motor controller 25 is manually operated to control the flow rate of air being fed into the spray chamber 9 by the filter unit 23. The shutters 18 and 19 are mounted on the top of the spray chamber 9 together with a bar type ionizer 24. The bar type ionizer 24 charges air coming in through the filter unit 23 to the same polarity as the atomized spacer 3, i.e., positive polarity. Again, the shutters 18 and 19 each is so adjusted as to steer air with positive ions in a particular direction, so that the spacer 3 is prevented from depositing on the walls of the spray chamber 9.

In summary, in accordance with the present invention, a first shutter is adjusted to direct air with positive ions and introduced into a spray chamber via the top of the chamber toward the side walls of the chamber, thereby charging the walls to positive polarity. As a result, repulsion acts between the side walls of the chamber and an atomized spacer also charged to positive polarity, preventing the spacer from depositing on the side walls. On the other hand, a second shutter is adjusted to direct the above air vertically downward toward the bottom of the chamber, preventing the spacer from flowing upward due to convection. The shutters therefore reduce the cohesion of the spacer on the walls of the spray chamber and in addition obviates the waste of the spacer. This reduces not only the amount of spacer for a single substrate but also the frequency of cleaning of the spray chamber.

Various modifications will become possible for those skilled in the art after receiving the teachings of the present disclosure without departing from the scope thereof.

What is claimed is:

1. A spacer spraying device, comprising a spray chamber in which a stage for supporting a substrate is positioned, said spray chamber having inner side walls, a shutter that directs air in said spray chamber, a nozzle for spraying a spacer in said spray chamber toward said stage, an air conduit communicating with said spray chamber and separate from said nozzle, said air conduit feeds air from an outside to an inside of said spray chamber, and an ionizer in communication with said air conduit, wherein said ionizer operates to ionize the air fed into said spray chamber by said air conduit to charge this air to a same polarity of the sprayed spacer to prevent spacer from depositing on said inner side walls of said spray chamber.

2. The device as claimed in claim 1, further comprising a filter unit connected to said air conduit, said filter unit filters the air fed into said spray chamber by said air conduit.

3. The device as claimed in claim 1, wherein said shutter includes an adjuster that adjusts the air fed into said spray chamber by said air conduit.

4. The device as claimed in claim 1, wherein said shutter comprises a first shutter adjusted to direct air toward at least one of said inner side walls, and a second shutter adjusted to direct air vertically downward toward a bottom of said spray chamber.

5. The device as claimed in claim 2, wherein said air conduit is a dry air conduit connected to said filter unit for feeding dry air into said spray chamber.

6. The device as claimed in claim 1, further comprising a fan for forcing the air fed into said spray chamber by said air conduit.

7. The device as claimed in claim 1, wherein the air fed into said spray chamber by said air conduit is charged to a positive polarity.

8. The device as claimed in claim 1, wherein the inner side walls of said spray chamber are charged to a positive polarity.

9. The device as claimed in claim 1, wherein a substrate for an LCD is positioned on said stage.

10. The device as claimed in claim 1, wherein said inner side walls are vertical.

* * * * *

UNITED STATES PATENT AND TRADEMARK OFFICE

CERTIFICATE OF CORRECTION

PATENT NO. : 6,190,456 B1
DATED : February 20, 2001
INVENTOR(S) : Akehiro Matsuda It is certified that error appears in the above-identified patent and that said Letters Patent is hereby corrected as shown below:

Column 2,
Line 35, delete "35 0 kV" insert -- ± 0kv --

Column 3,
Line 1, delete "6" insert -- 5 --

Signed and Sealed this

Twenty-ninth Day of January, 2002

*Attest:*

*Attesting Officer*

JAMES E. ROGAN
*Director of the United States Patent and Trademark Office*